United States Patent [19]

Brecy

[11] Patent Number: 5,002,267

[45] Date of Patent: Mar. 26, 1991

[54] APPARATUS FOR AUTOMATIC FEEDING OF ONE DOCUMENT AT A TIME TO A DOCUMENT PROCESSING MACHINE

[75] Inventor: Andre Brecy, Hericourt, France

[73] Assignee: Bull S.A., Paris, France

[21] Appl. No.: 424,766

[22] Filed: Oct. 20, 1989

[30] Foreign Application Priority Data

Oct. 21, 1988 [FR] France ..... 88 13863

[51] Int. Cl.[5] ..... B65H 3/04; B65H 3/44

[52] U.S. Cl. ..... 271/9; 271/3

[58] Field of Search ..... 271/9, 34

[56] References Cited

U.S. PATENT DOCUMENTS 2,594,499 4/1982 Rumph ..... 270/58
4,108,427 8/1978 Komori et al. ..... 271/9

FOREIGN PATENT DOCUMENTS 0022957 1/1981 European Pat. Off. .
183422 9/1985 Japan ..... 271/9
2101354 1/1983 United Kingdom ..... 271/9

OTHER PUBLICATIONS

IBM Technical Disclosure Bulletin vol. 14, No. 9, p. 2786, Feb. 1972, W. Goff Jr. "Multiple Hopper Paper Feed".

IBM Technical Disclosure Bulletin, vol. 18, No. 12 pp. 3915, 3916, May 1976, "Recirculating Original Document Feed for Copier", M. J. Miller.

*Primary Examiner*—Richard A. Schacher

*Attorney, Agent, or Firm*—Kerkham, Stowell, Kondracki & Clarke

[57] ABSTRACT

The invention relates to an apparatus for automatic feeding of one document at a time to a document processing machine. The apparatus (10) includes a movable horizontal turntable (12) on which bins (C1, C2, . . . , C8) are affixed, each containing a stack of documents. A drive device (15, 16, 28) controls the displacement of the turntable in order to move a preselected bin into an unloading position (90), facing the processing machine (11). The turntable is provided with bin identification (ME1, ME2, . . . , ME8), and the drive device is controlled by a control circuit (91) that excites the drive device in such a way that the displacement of the turntable to move a preselected bin into the position (90) is effected by the smallest possible rotation. The invention is applicable to sheet feeding to a printing machine.

28 Claims, 8 Drawing Sheets

APPARATUS FOR AUTOMATIC FEEDING OF ONE DOCUMENT AT A TIME TO A DOCUMENT PROCESSING MACHINE

FIELD OF THE INVENTION

The present invention relates to an apparatus for automatic feeding of one document at a time to a document processing machine. More particularly, but not exclusively, such an apparatus is used for successive feeding of sheets of paper that are to be printed by a high-speed printing machine.

BACKGROUND OF THE INVENTION

In recent years, improvements to high-speed printing machines, such as those operating by the principle of magnetography, have made relatively high printing speeds, on the order of 60 to 90 pages per minute, and even more, attainable.

Earlier printers that operated at a printing speed of 15 to 20 sheets per minute were generally provided with feeding bins that could hold up to 2000 sheets. In this way, these machines could operate for nearly two hours without refilling.

With the high-speed printers that have been developed recently, this kind of capacity of the sheet feeding bin proves quite insufficient, because it allows the machine to function without refilling for only 20 to 30 minutes. Under these conditions, the operator necessarily has to refill the bin two to three times per hour and is quite tedious when the operation has to be repeated more than 10 times a day. This procedure is also increasingly inconvenient when each time the machine is refilled, the operator must first stop printer operation, replace a stack of sheets in the bin of the stopped machine, and then start the machine up again and perform a long series of monitoring operations before allowing printing operation to resume. Furthermore, these stoppages, when they recur often, have the effect of notably increasing the total downtime of the machine, so that naturally in the end, the high printing speed of the machine proves illusory.

To overcome this disadvantage, it is possible to provide for a greatly increased bin capacity, but this does not yield the expected results, because the sheets at the bottom of the pile in the bin are subjected to excessive pressure from the sheets above them, which causes them to stick together. The sheets continue to stick together continues even if the successive removal of the sheets, which is assured by an extracting device disposed above the stack of sheets, reduces the height of the stack to that of a stack containing 2000 sheets, or even less. These sheets, which still stick together, can no longer be separated easily by the extractor, so they jam, which obliges the operator to stop the machine and intervene to disengage the sheets that are wedged together. For this reason, in some feeders of the prior art, such as those described in French Patent Nos. 1.533.917 and 2.203.368 (the latter corresponding to U.S. Pat. No. 3,920,238), and European Patent Applications published as Nos. 0029647 and 0103661, the sheets that are to be printed are held in a plurality of feed bins, rather than only a single one, and each of the bins is arranged to hold no more than a certain number of sheets, virtually not exceeding 2000. In each of these bins, sheet extraction is performed by an electromechanical extractor which when placed in contact with the topmost sheets of the stack stored in the bin, each time it is excited for a brief moment by an electrical current, causes one sheet to be extracted from the bin. In these feeders, each feed bin is necessarily provided with not only an electromechanical extractor arranged to be controlled at predetermined moments, but also with precise guide elements enabling the sheets extracted from the bin to be oriented along a common advancement track so that they will then be routed toward the printing device. As a result, for fewer stoppages of the machine without increasing the capacity of the bins, a feed apparatus of this type has been made that includes a large number of bins, for example on the order of 10; such an apparatus proves particularly expensive and intricate to manufacture, because of the large number of extractiors and guide elements involved in its structure.

A feed apparatus is also known, described in U.S. Pat. No. 4,108,427, that includes a plurality of feed bins disposed horizontally one above the other, but offset by a constant amount with respect to one another, so that each bin has an uncovered portion that can be engaged by an electromechanical sheet extractor. In this apparatus, the feed bins are integrally connected to a transport carriage that can be displaced along a direction parallel to the direction of offset of the bins, to permit any one of the bins to be put into an unloading position in which the stack of sheets stored in the bin is in contact with the electromechanical extractor. However, in this apparatus, the displacement of the transport carriage is accomplished by means of an extremely complicated assembly of shafts, cams and articulated levers, which must be machined and assembled with very great precision in the manufacture of the apparatus, or else in the course of carriage displacement the sheets contained in the various bins may be torn, or at least creased, from improper contact of the sheets with the extractor. As a result, the manufacture of such an apparatus can be undertaken only by using a specialized set of machine tools and highly qualified workers, so this apparatus proves to be especially expensive in the final analysis. Furthermore, the displacement of the carriage to put the bin in the unloading position proceeds relatively slowly, making this apparatus unsuitable for feeding sheets to a high-speed printer. Finally, this apparatus does not include any control means enabling a bin selected in advance by the operator to be moved automatically to the unloading position.

OBJECT AND SUMMARY OF THE INVENTION

The present invention overcomes all these disadvantages and proposes an automatic document-by-document feeding apparatus that while including a relatively large number of document feeding bins and a single extractor makes it possible to furnish the documents at a rate compatible with the operating rate of the processing machine to which the documents are delivered; the placement of any of the bins in the unloading position takes place at high speed, entirely automatically, without causing deterioration of the documents and without necessitating stoppage of the processing machine.

More precisely, the present invention relates to an apparatus for automatic feeding of one document at a time to a document processing machine; the apparatus includes a plurality of feed bins, provided so that each holds one stack of documents to be processed and fixed to a movable support that can be displaced by a drive device along a predetermined path enabling each bin to be moved to an unloading position provided with a document extractor, and the extractor is arranged to control the extraction of the documents one by one from a stack that has been put in contact with it. According to the invention, the bins are each assigned an order number corresponding to the order in which they succeed one another on the support, and the apparatus also includes a drive device control circuit that includes:

a recognition device arranged to recognize the order number of the bin in the unloading position, and to generate electrical signals representative of the order number;

a first register for temporarily holding a number corresponding to a preselected bin which is to be put into the unloading position;

a second register for temporarily holding each of the order numbers delivered in succession, in the form of electrical signals, by the recognition device;

and a control block connected to these two registers and arranged to excite the support drive device as a function of the order numbers contained in the respective registers, in such a manner as to move the preselected bin into the unloading position.

The present invention will be better understood and further objects, details and advantages thereof will become more apparatus from the ensuing detailed description of a non-limiting exemplary embodiment, taken in conjunction with the drawings.

DESCRIPTION OF THE PREFERRED EMBODIMENTS

Figure 1:
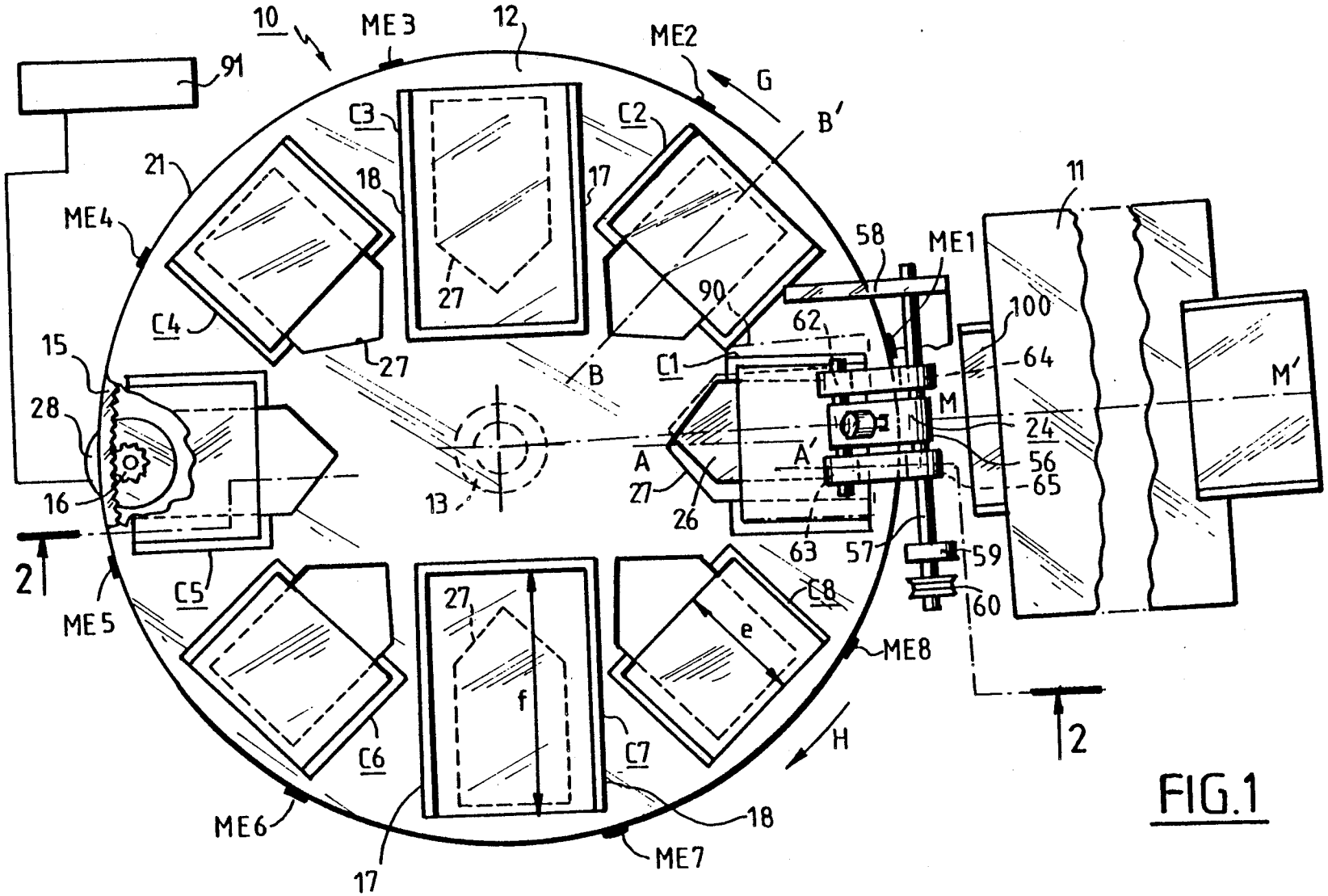
FIG. 1 is a plan view of an automatic document feeding apparatus according to the invention.

FIG. 1 shows a feed apparatus 10 that when embodied according to the invention can be used to deliver documents to a wide variety of document processing machines. In the example described, this processing machine is a magnetographic printer 11 that prints sheets of paper delivered one by one by the feed apparatus 10. However, the feed apparatus may certainly also be adapted to deliver documents to some other type of document processing machine, such as a check sorting machine or a card reader for cards provided with indications that are identifiable by an automatic recognition device.

Figure 2:
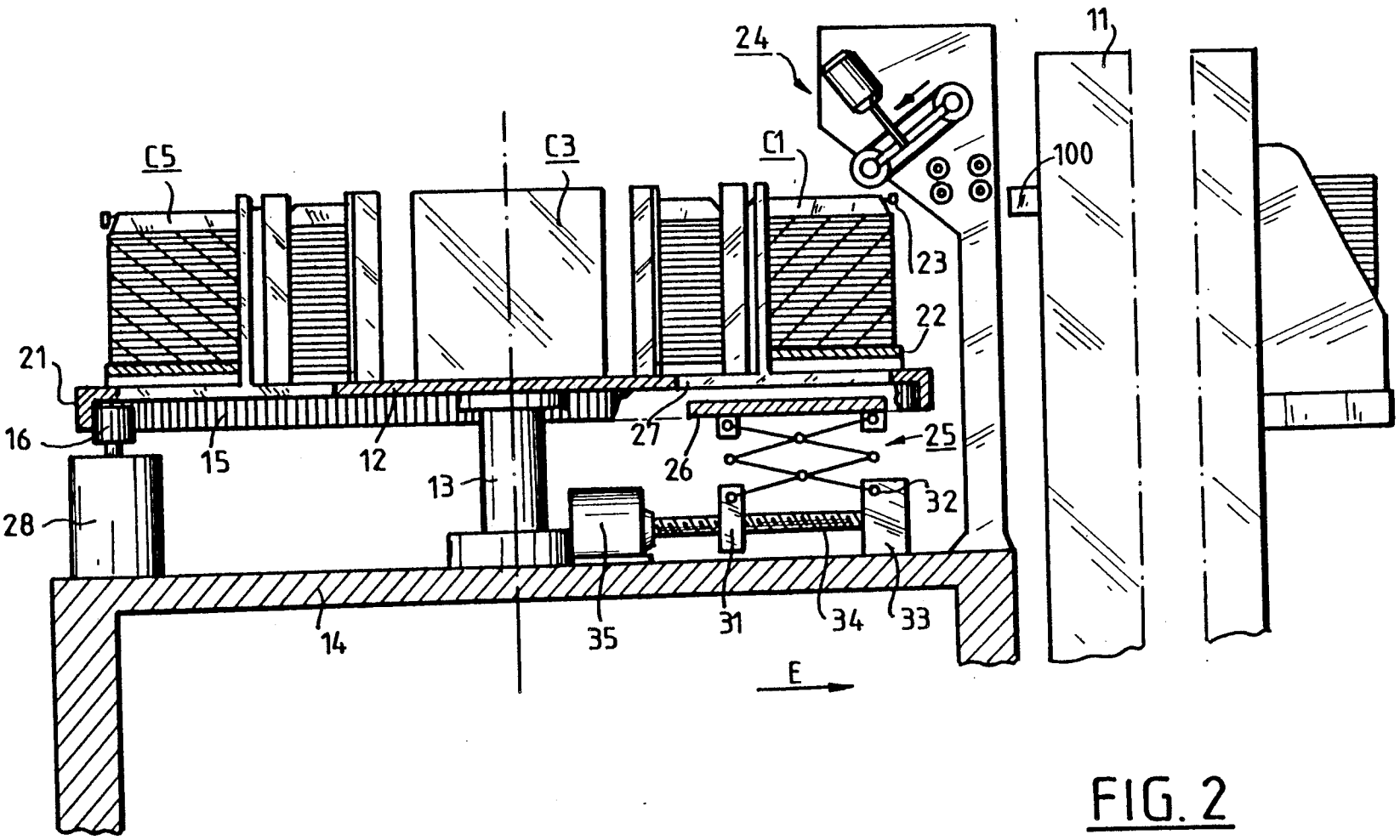
FIG. 2 is a sectional view of the apparatus taken along the line 2—2 in FIG. 1, showing the transport mechanism that makes it possible for a stack of documents to be put into contact with the extractor.

The feed apparatus 10 shown in FIG. 1 includes a plurality of feed bins C1, C2, C3, and so forth, each containing one stack of sheets of paper that are to be printed by the printer 11. The bins, in this case eight in number, are integrally connected to a circular turntable 12, which is disposed horizontally and mounted to pivot on a vertical rotation shaft 13, which in turn is affixed, as FIG. 2 shows, to a horizontal support plate 14 that is part of the frame of the apparatus. The circular turntable 12 is provided with a toothed ring 15 affixed under the circular edge 21 of the turntable and meshing with a pinion 16 integrally joined to the drive shaft of an electric motor 28. When the electric motor 28 is excited as described hereinafter, the pinion 16 rotates and drives the ring 15 and the turntable 12 to rotate about the shaft 13.

As can be seen in FIG. 1, the feed bins C1, C2, . . . , C8 are disposed at regular intervals along the circular edge of the turntable 12. The bins C1, C2, C4, C5, C6 and C8 are all identical and are arranged to contain sheets of paper of the well-known standard size DIN A4, while the bins C3 and C7, which are identical to one another but larger in size than the bins C1, C2, C4, C5, C6 and C8, are arranged to contain sheets of paper of the standard size DIN A3. Each of the bins has a vertical plane of symmetry that passes along the axis of rotation of the turntable 12. By way of example, the planes of symmetry AA′ and BB′ of two adjacent bins C1 and C2 have been shown in FIG. 1. Since in the example described the number of feed bins is eight, the planes of symmetry of any two adjacent bins form angles of 45° with one another.

The printing machine 11 will not be described, because it is not part of the invention. Nevertheless, it should be noted that it is provided with an entry chute 100 by way of which the sheets delivered by the feed apparatus 10 are engaged by the machine. This entry chute 100, which normally includes sheet guiding and driving elements (not shown), has a vertical plane of symmetry MM′, and the feed apparatus 10 and printer 11 are disposed in such a manner with respect to one another that this plane MM′ passes through the axis of rotation 13 of the turntable 12, as can be seen in FIG. 1.

Figure 3:
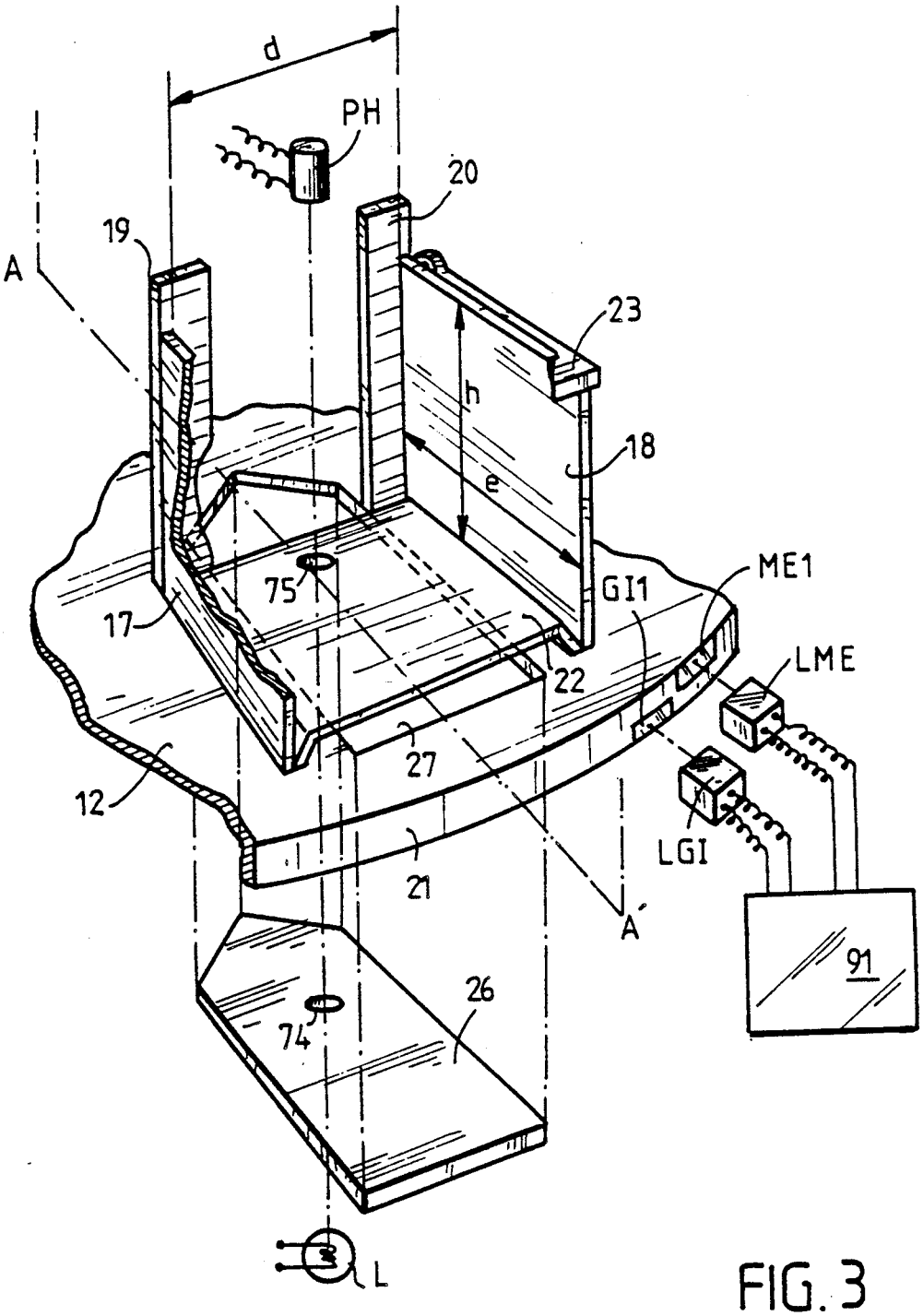
FIG. 3 is a perspective view showing in detail the structure of one of the feed bins with which the apparatus shown in FIG. 1 is equipped.

Turning now to FIG. 3, the structure of one of the feed bins, for example the bin C1, will now be described. The bin C1 includes two vertical plates 17 and 18, which are affixed to the circular turntable 12 symmetrically, one on either side of the plane of symmetry AA′ of the bin. These two plates are spaced apart from one another by a distance d which is slightly greater than the length of the sheets of A4 paper. Two slides 19 and 20, affixed to the vertical edges of the plates 17 and 18 farthest from the circular edge 21 of the turntable 12, are intended to assure guidance of a stack of sheets that has been placed on a movable support plate 22, which is disposed horizontally between the vertical plates 17 and 18. In FIG. 3, this support plate 22 occupies a position of repose in which it contacts the turntable 12. Each of the vertical plates 17 and 18 extends in a direction parallel to the plane of symmetry AA′, over a horizontal distance e which is slightly greater than the width of sheets of A4 paper. Each of these plates is provided with a device 23 for separating sheets, of a known type, which is disposed where the upper edge of the plate intersects its vertical edge closest to the circular edge of the turntable 12 and makes it possible for the topmost sheet of a stack of sheets, which has been put into contact with this device, to be separated completely safely from the other sheets of this stack when this sheet is driven by a friction extractor 24 (FIG. 2) to be described hereinafter.

It should also be noted that as can be seen from FIG. 3, the plates 17 and 18 have a height such that when a stack of sheets including about 2000 sheets is put in place on the support plate 22 immobilized in a position of repose, the topmost sheet of the stack is located at a lower level than the separating device 23. To enable this topmost sheet to be put into contact with this device 23, it is accordingly necessary to raise the plate 22 on which the stack rests. This is accomplished by a transport mechanism 25 (FIG. 2), which will be described in detail hereinafter and as can be seen from FIG. 3 includes an elevator platform 26 arranged so that it can pass through an opening 27 formed in the circular turntable 12, between the plates 17 and 18 of the feed bin. The shape and dimensions of the opening 27 are dictated by the size and disposition of the feed bins. It should be noted that the bins C3 and C7, which are intended to contain A3 sheets, are each similar in structure to the bin C1 shown in FIG. 3, with the difference that as can be seen in FIG. 1 the plates 17 and 18 comprising each of the bins C3 and C7 extend, in a direction parallel to the plane of symmetry of these two bins, over a horizontal distance f slightly greater than the length of the sheets of A3 paper; thus this distance f is practically twice the corresponding distance e of each of the plates 17 and 18 of the other bins. FIG. 1 shows that the opening 27 of the bins C3 and C7 extends in a direction parallel to the plane of symmetry of these bins over a length close to this distance f, and that the openings 27 of the bins C1–C8 are all identical, so that the openings 27 of the bins C1, C2, C4, C5, C6 and C8 extend to the outside of the bins, toward the center of the turntable 12. With this arrangement, the elevator platform 26, which is in engagement with any opening 27 suitably positioned with respect to this platform, can raise the support plate 22 that rests on this opening without risking imbalancing this plate and causing it to rock back and forth.

Naturally the engagement of the elevator platform 27 in one of the openings 27 of the feed bins cannot occur when the circular turntable 12 is in motion. Accordingly, when the turntable 12 is rotationally driven by the motor 28, the elevator platform 26 normally occupies a position of repose, which as FIG. 2 shows is located beneath the turntable 12, or in other words outside the path taken by this turntable 12 and the bins C1–C8. As will be seen below, the raising of the elevator platform 26 from this position of repose is not commanded unless a feed bin has been moved into an unloading position and then immobilized there; this position is indicated in FIG. 1 by a dot-dash line 90 and corresponds to the position that the bin occupies when the plane of symmetry of the bin coincides with the plane of symmetry MM' of the entry chute 100 of the machine 11. The movement of one of the bins C1–C8 into position in this unloading position 90 is obtained by exciting the motor 28, which is provoked by a control circuit 91 to be described hereinafter. It should again be noted that when a bin is positioned in this position 90, that is, when the plane of symmetry of the bin coincides with the plane MM', the elevator platform 26 faces the opening 27 of this bin and so is capable of leaving its position of repose so as to pass through the opening without the risk of colliding with the circular turntable 12.

Figure 4:
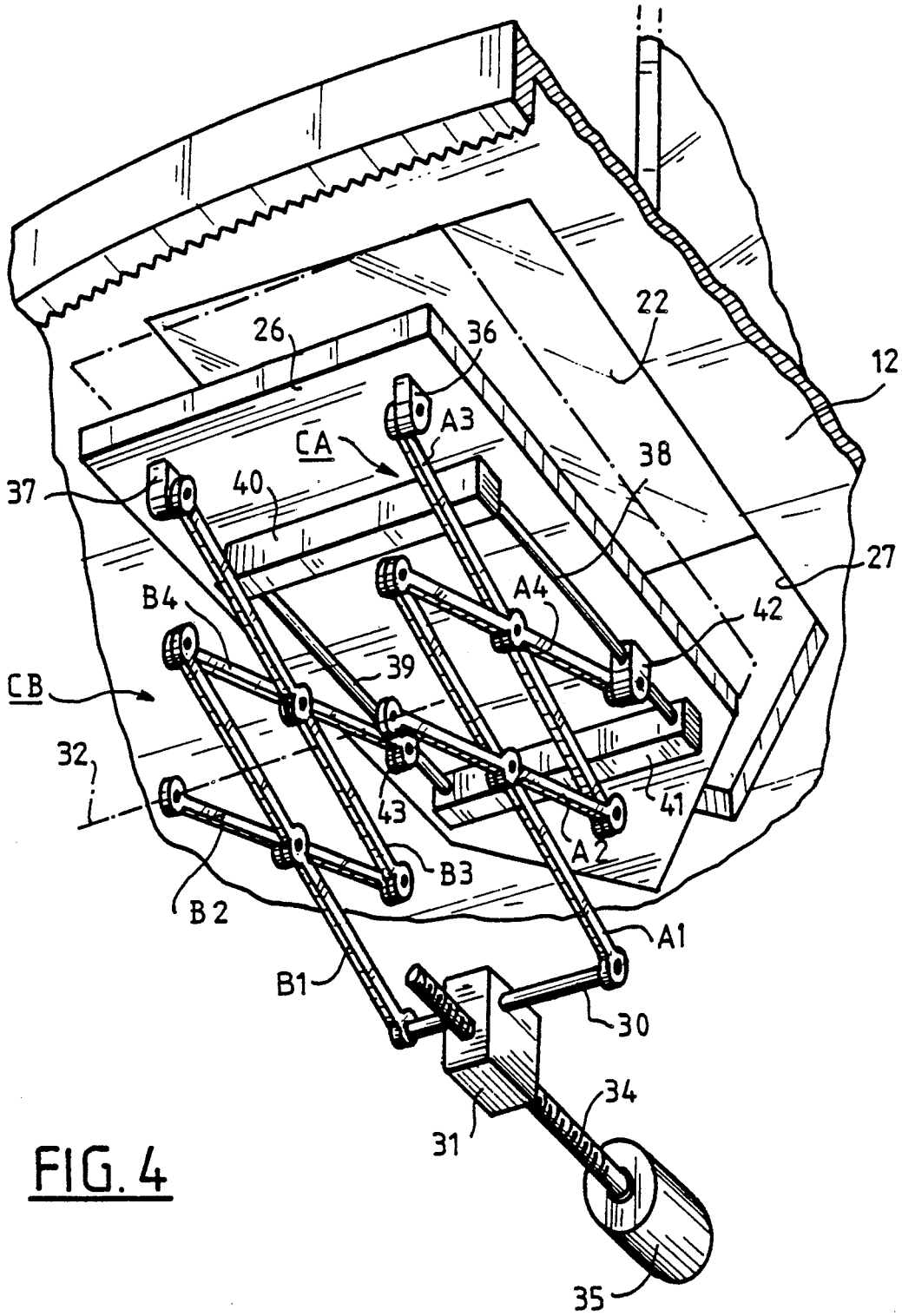
FIG. 4 is a perspective view showing the detailed structure of the stack transport mechanism with which the apparatus of FIG. 1 is equipped.

The transport mechanism 25 with which the feed apparatus 10 shown in FIGS. 1 and 2 is equipped is shown in detail in FIG. 4. In the embodiment shown in FIG. 4, this mechanism 25 includes two similar extensible cross braces CA and CB which are arranged so as to be capable of being pulled in a vertical direction; each of these cross braces is made up of a set of rods articulated both in the middle and at their ends, as FIG. 4 shows. In the example described, the cross brace CA includes four articulated rods A1, A2, A3 and A4, and the cross brace CB similarly includes four articulated rods B1, B2, B3 and B4; these two cross braces thus have four lower rods A1, A2, B1 and B2, which are parallel two by two, and four upper rods A3, A4, B3 and B4, again parallel two by two. The two lower parallel rods A1 and B1 are made integral with one another by a shaft 30 that extends between the two cross braces CA and CB and is affixed to the free ends of these two rods; the shaft 30 passes through a movable block 31 inside which it is capable of rotating. The other two lower parallel rods A2 and B2 are articulated at their free end on a shaft 32, which as FIG. 2 shows is part of a fixation block 33 integrally connected to the horizontal support plate 14. The movable block 31 is provided with a thread that allows it to slide along a horizontal threaded rod 34 affixed to the drive shaft of an electric motor 35, which as can be seen in FIG. 2 is mounted fixedly to the support plate 14. To lessen the risk of jamming, the threaded rod 34 is provided at its end with an unthreaded portion that engages a suitably lubricated hole of the fixation block 33. Returning to FIG. 4, it can be seen that the elevator platform 26 is provided on its lower face with two articulation feet 36 and 37, on which the free ends of the two upper parallel rods A3 and B3 are articulated. The elevator platform 26 is further provided with two guide rods 38 and 39, disposed parallel to the horizontal threaded rod 34 and extending between two retaining bars 40 and 41 that are affixed to the lower face of the elevator platform 26. Two sliding elements 42 and 43, each articulated respectively to each of the free ends of the other two upper parallel rods A4 and B4, slide on these two rods 38 and 39. It will thus be appreciated that when the motor 36 is excited and rotates in one direction, which has the effect of displacing the movable block 31 in the direction of the fixation block 33 (this displacement is indicated in FIG. 2 by the arrow E), the two cross braces CA and CB deform in such a manner that their articulated rods move together in the vertical direction, thus extending these two cross braces upward. Consequently the platform 26 rises to meet the support plate 22, which is located above it; then once it has contacted the plate it raises both the plate and the stack of sheets resting on the plate, and this movement continues until the instant when the motor 35 ceases to be excited. Contrarily, when the motor 35 is excited in such a way as to rotate in the opposite direction, the movable block 31 is displaced in the opposite direction to that of the arow E, and consequently the platform 26 descends again to resume its position of repose.

Naturally the transport mechanism 25 may be in some other form than that shown in FIGS. 2 and 4. In the exemplary embodiment shown in FIG. 5, this mechanism 25 includes a rack 50, which is affixed vertically below the elevator platform 26 and guided in its vertical displacement by rollers 51; this rack is made to mesh with the teeth of a toothed wheel 52 which in turn engages the threads of an endless screw 53 integrally connected to the drive shaft of the electric motor 35. When the motor 35 is excited and rotates in such a way as to drive the toothed wheel 52 in the direction indicated by the arrow in FIG. 5, the platform 26 is displaced upward from its position of repose (shown in dot-dash lines in FIG. 5); after having passed through the opening 27 it raises the plate 22 and hence the stack of sheets 54 located on this plate. The rise of the platform 26 continues until the instant when the topmost sheet of this stack 54 has reached a level in which it can contact the separating device 23. Beginning at this instant, the sheets of this stack can be extracted one by one by the extractor 24, and the rise of the platform 26 proceeds at the rate of extraction of the sheets, being automatically controlled by means for detecting the topmost level of the sheets. The detection means, here comprising a bidirectional switch CF actuated by the topmost sheet of the stack, control the rise of the platform 26 in a manner to be described hereinafter. It should be noted here that each of the feed bins C1–C8 shown in FIGS. 1 and 2 is equipped with such a switch, but these switches have not been shown in the two drawing figures for obvious reasons of simplicity. Moreover, each of these switches is associated with a flexible contactor 45, which as can be seen in FIG. 5 includes three sliding contact elements G1, G2 and G3, which when the feed bin provided with this switch CF is moved into the unloading position 90 come to rest on three conductor bars T1, T2 and T3 affixed to an insulating block 46 integrally connected to the support plate 14; thus the three elements G1, G2 and G3 and the three bars T1, T2 and T3 permit this switch to be electrically connected to the control circuit 91 to be described hereinafter.

Figure 5:
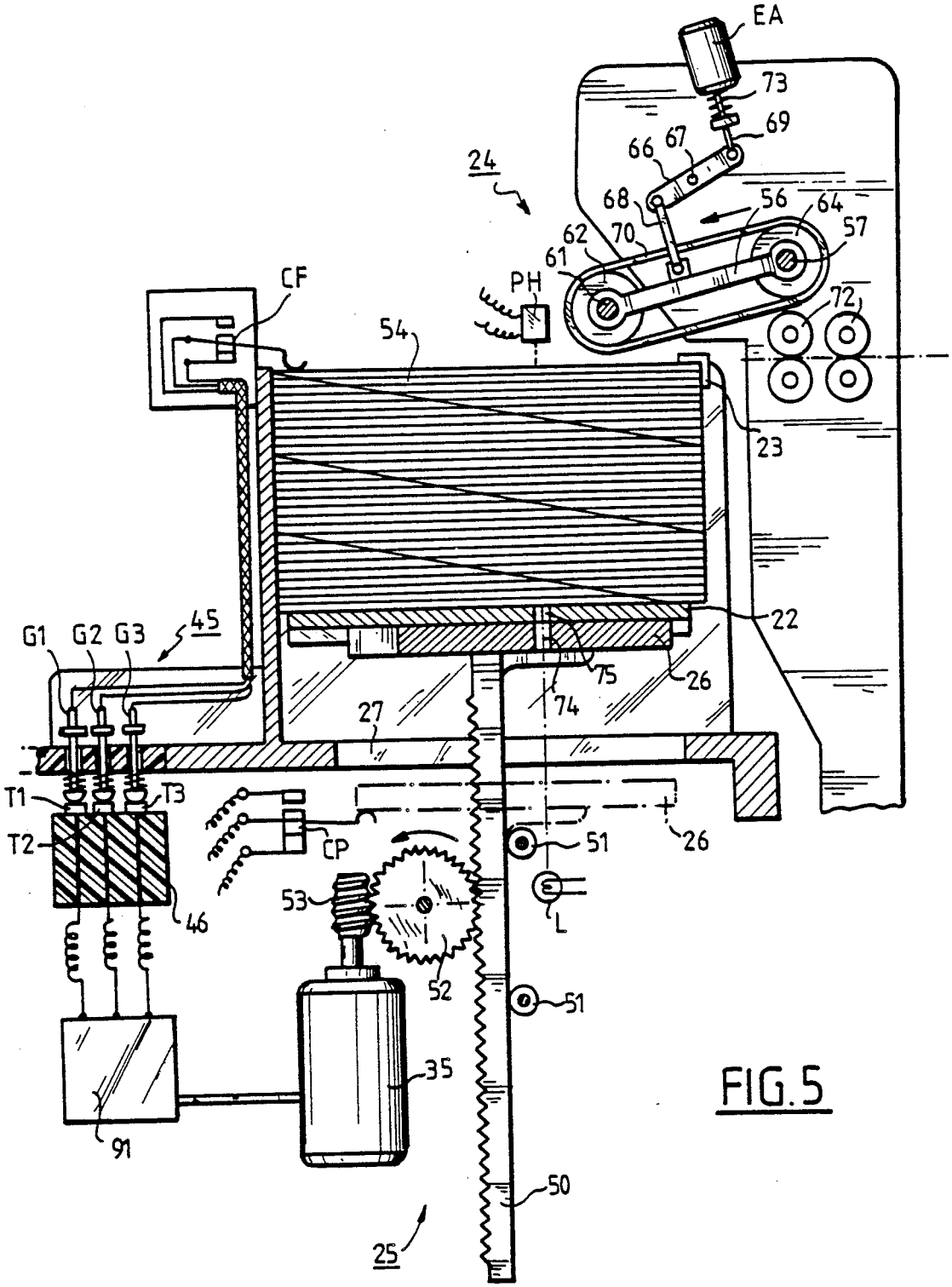
FIG. 5 is a sectional view showing a variant embodiment of the stack transport mechanism, as well as certain details of the document feeding apparatus.

The feed apparatus shown in FIGS. 1 and 2 also includes another bidirectional switch CP, which as FIG. 5 shows is disposed below the elevator platform 26, in such a manner as to be actuated by this platform when the platform leaves its position of repose or contrarily returns to its position of repose.

FIGS. 1 and 5 show that the extractor 24 includes an arm 56 that is articulated at one of its ends to a shaft 57 disposed horizontally between two vertical members 58 and 59 that are integrally connected to the support plate 14. The shaft 57 is arranged to pivot in bearings (not shown) affixed to the vertical members 58 and 59 and is driven to rotate continuously by a motor (also not shown), via a drive pulley 60 affixed to the shaft 57. The arm 56, which is capable of pivoting freely about the shaft 57, supports a second shaft 61 at its other end, the second shaft disposed parallel to the shaft 57. Affixed to the shaft 61 are two pulleys 62 and 63 placed on either side of the arm 56. Two other pulleys 64 and 65, disposed on either side of the arm 56, are affixed to the shaft 57. A belt 70 drawn by the pulleys 62 and 64 is driven for displacement in the direction indicated by an arrow in FIG. 5, in the same manner as another belt which is stretched over the pulleys 63 and 65; the drive of these two belts is brought about by the rotation of the shaft 57. Pivoting of the arm 56 about the shaft 57 is controlled by a lever 66, mounted to pivot on a shaft 67 and connected at one of its ends to the arm 56 by way of a rocker bar 68. Articulated to the other end of this lever 66 is a rod 69 integrally connected to the movable armature of an electromagnet EA. In FIG. 5, the constituent elements of the extractor 24 are shown in the position of repose, which is the position these elements occupy when the electromagnet EA is not excited. In this position the two belts of the device 24 are kept out of contact with a stack of sheets 54, which has been raised by the platform 26 and put into contact with the separating device 23, as the drawing figure shows. If the electromagnet EA is now excited for a brief moment by an electrical current of suitable intensity, the rod 69 is actuated by the attracted armature and compels the lever 66 to pivot about its axis, thus causing the arm 56 to pivot downward and putting the two belts in contact with the topmost sheet of the stack 54. Consequently the topmost sheet, driven by these belts, is separated from the stack by the device 23 and is engaged between drive rollers 72, which then force this sheet into engagement with the entry chute 100 of the machine 11. The structure of the device 23 that permits the sheet driven by the belts to be separated from the other sheets in the stack will not be described here, because this device is similar to that described and shown in U.S. Pat. No. 2,912,241. The rod 69 is provided with a compression spring 73, which when the electromagnet EA ceases to be excited permits the extractor 24 to return to the position of respose.

As can be seen in FIGS. 3 and 5, the elevator platform 26 is provided with an opening 74, which is located on the path of a beam of light transmitted by a lamp L to a photoelectric cell PH; the lamp and cell are held in fixed support elements, not shown. Similarly, each support plate 22 is pierced by a hole 75, which when the corresponding feed bin is immobilized in the unloading position 90 is located in the path of this beam. It will accordingly be understood that the beam is intercepted, as long as the sheets rest on the plate 22 of the bin that is immobilized in this unloading position. Contrarily, as soon as the last sheet of a stack placed on this plate has been extracted by the extractor 24 so as to be engaged in the entry chute of the machine 11, the cell PH receives the beam of light transmitted by the lamp L and then furnishes an electrical signal to the control circuit 91 to be described hereinafter.

To permit each of the bins C1–C8 to be moved rapidly into an unloading position and to be positioned correctly with respect to the entry chute 100 of the printing machine 11, the feed apparatus shown in FIGS. 1 and 2 is provided with identification labels ME1, ME2, . . . , ME8, which are equal in number to the number of feed bins C1, C2, . . . , C8 and are each assigned to each of these bins respectively, the labels being displaced at regular intervals along the circular edge 21 of the turntable 12, in such a manner that as the turntable rotates they pass before a label reader LME (shown in FIG. 3). Each of these identification labels has a characteristic marking, which differs from one label to another, and which represents in encoded form the order number of the bin to which it is assigned; the order numbers of the bins C1–C8 are in succession from 1 to 8, with the bin C1 marked by the number one. Hence the identification label assigned to the bin C5, for example, has an encoded marking representing the numeral 5. The respective disposition of the identification labels and of the label reader LME is such that the marking carried by the identification label assigned to a predetermined bin is read by the reader LM at the precise instant when this bin, driven in the course of the rotation of the turntable 12 by the motor 28, arrives in the unloading position 90. Under these conditions, in the course of the rotation of the turntable 12, the reader LME reads the various encoded markings carried by the labels passing before it, and each time a bin enters the position 90, it sends the order number represented by the encoded marking assigned to this bin to the control circuit 91. Thus as will be seen hereinafter, at the instant when a predetermined bin enters the position 90, or in other words at the instant when the circuit receives the order number corresponding to this bin from the reader LME, the control circuit can then de-excite the motor 28 in order to stop the bin in this position 90. However, the stoppage of the motor 28 does not take place instantaneously, and so once the bin is stopped it is not yet correctly positioned with respect to the unloading chute 100. The circular edge 21 of the turntable 12 is therefore also provided with groups of position indicators GI1, GI2, . . . , GI8, only one of which, GI1, is visible in FIG. 3; these groups, equal in number to the bins C1, C2, . . . , C8, are each assigned respectively to each of these bins and disposed at regular intervals along the edge 21, in such a manner that when the turntable 12 is driven to rotate, they pass before an indicator reader LGI (FIG. 3). Each of these groups comprises a plurality of position indicators, which when the bin associated with this group is stopped in proximity with the unloading position 90 serve to determine the precise position of the bin with respect to this position. Without going into detail, it can simply be noted that the position indicators that are read by the reader LGI represent, in encoded form, the values of the angular spacing that the plane of symmetry of the bin that has been stopped in proximity with the position 90 can form with the plane MM' in one direction or the other. In response to the reading of these indicators, the reader LGI sends electrical signals to the control circuit 91, which have the effect of causing the excitation of the motor 28 to make it rotate in a suitable direction, in such a manner as to enable the plane of symmetry of this bin to coincide with the plane of symmetry MM' of the entry chute 100.

Figure 7A:
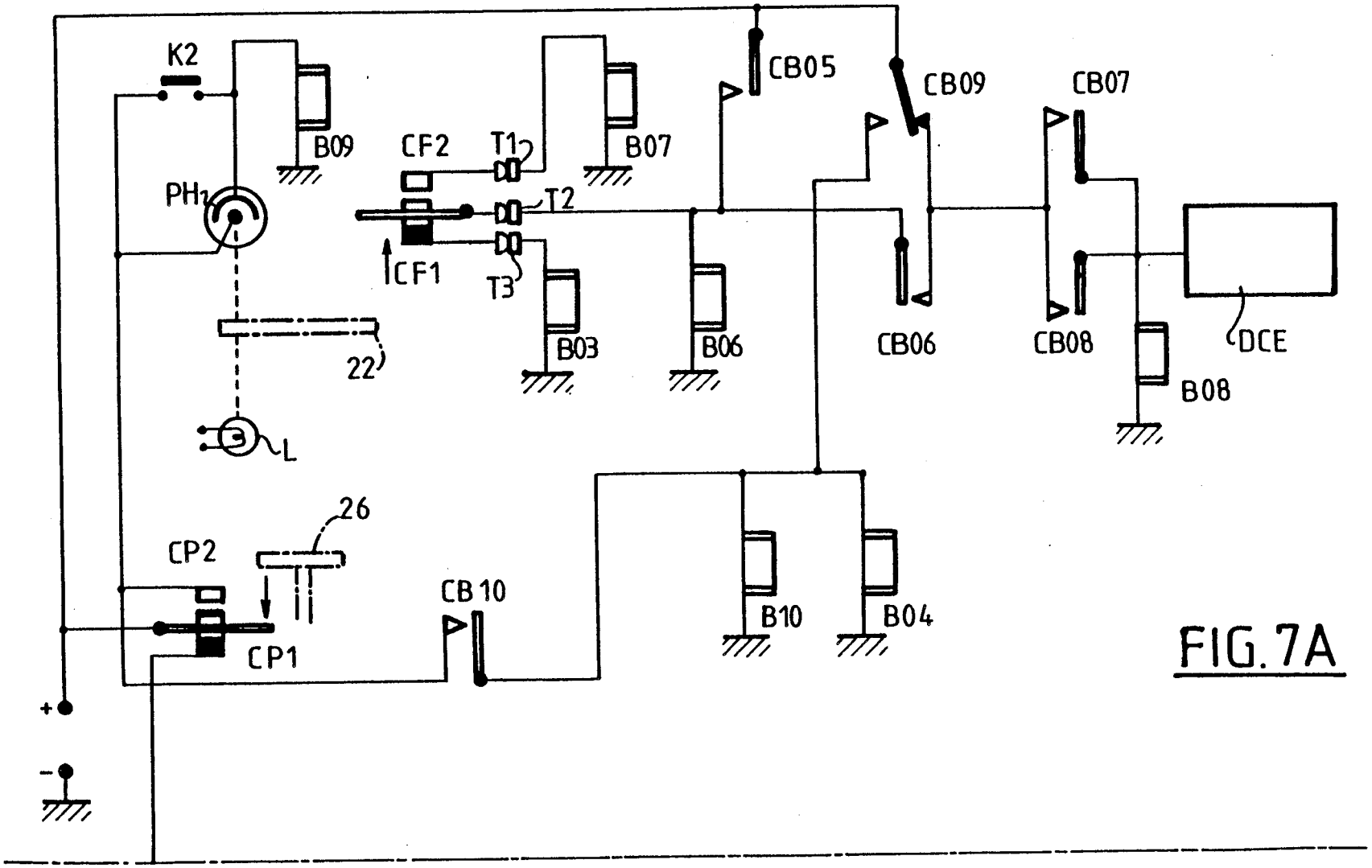
FIGS. 7A and 7B, assembled together, are a detailed diagram of the circuit used to control the functioning of the feed apparatus of FIG. 1.
Figure 7B:
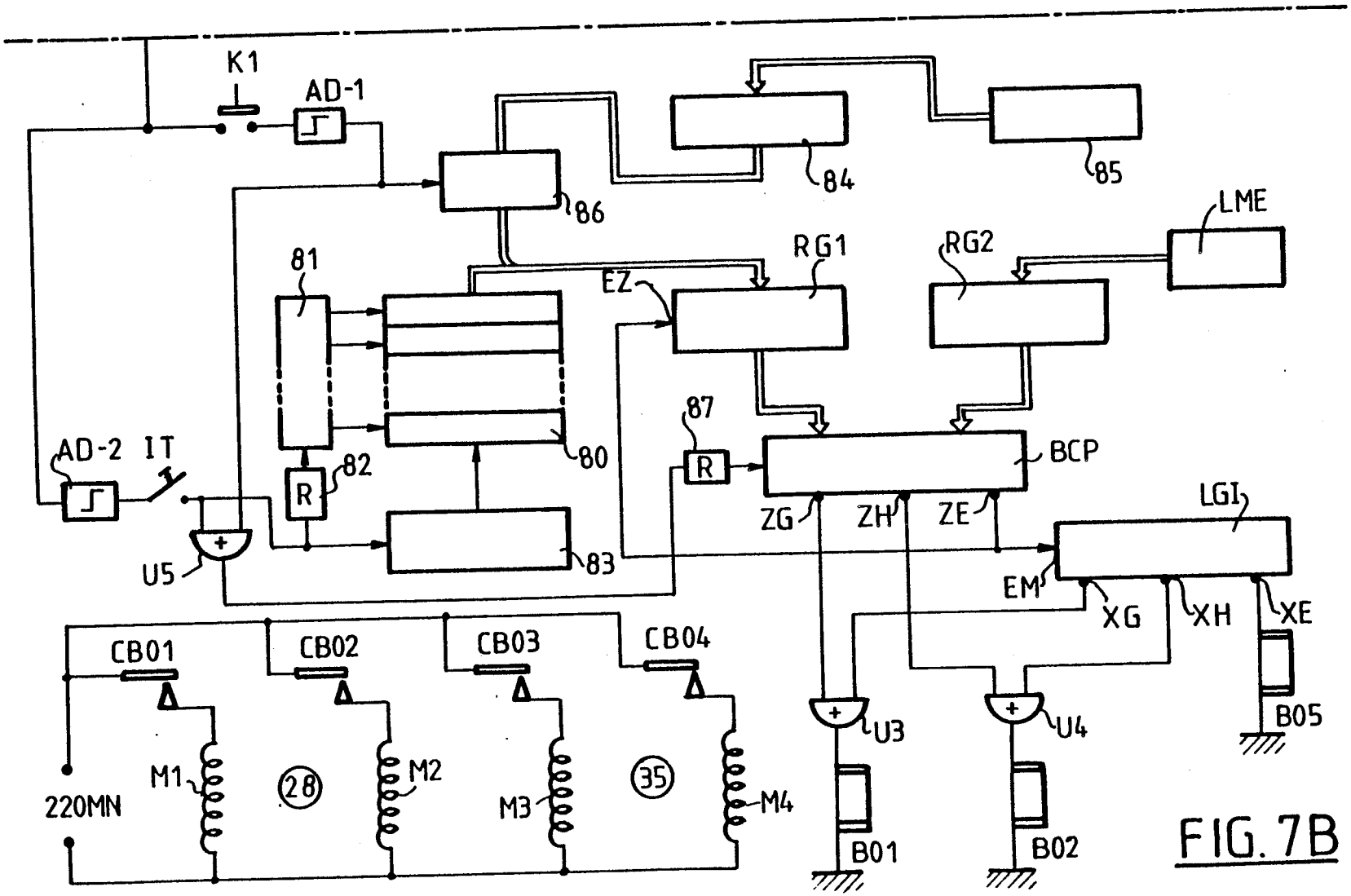

Turning now to FIGS. 7A and 7B, the electrical circuit 91 that controls the movements of the circular turntable 12 and elevator platform 26 belonging to the feed apparatus described above will now be described. In these figures, this circuit is shown in the form of a basic electrical diagram including logic circuits as well as manual control contacts and relay contacts provided so as to be used under conditions to be described below. The relay contacts are assigned the same reference numeral and the coil that they control, preceded by the letter C. A contact that is normally closed when the relay coil that it controls is not excited is shown in this diagram as a black triangle. The relays shown in FIGS. 7A and 7B are normally supplied with direct current picked up between two terminals + and −, the negative (−) terminal being grounded.

The electric motor 28 that drives the circular turntable 12 is a motor in which the reversal in the direction of rotation is obtained in a known manner, depending on the type of motor used. It is assumed in the example described and shown in FIG. 7B that the motor is of the alternating current type and includes two inductor windings M1 and M2 wound in opposition, so that when the winding M1 is excited, the motor 28 rotates in the direction in which it drives the turntable 12 in the direction indicated by the arrow G in FIG. 1, while when the winding M2 is excited, the motor rotates in the reverse direction. The two windings M1 and M2 can be supplied with monophase 220 V alternating current furnished by two terminals 220 MN, via two switch contacts CB01 and CB02 controlled respectively by two relay coils B01 and B02. Similarly, the motor 35 that controls the rise and fall of the platform 26 is similar to the motor 28 and includes two inductor windings M3 and M4 wound in opposition such that when the winding M3 is excited, the motor 35 rotates in one direction, which has the effect of causing the platform 26 to rise, while when the winding M4 is excited, the motor rotates in the reverse direction. The two windings M3 and M4 can be supplied with the alternating current furnished by the terminals 220 MN, via two switch contacts CB02 and CB04, controlled respectively by two relay coils B03 and B04.

The bidirectional switch CP includes two contacts CP1 and CP2; the contact CP1 is connected on the one hand, via a pushbutton K1, to the input of a drift amplifier AD-1, and on the other hand to the input of a drift amplifier AD-2. Each of the drift amplifiers is designed to furnish a single positive electrical pulse at its output each time its input is carried to a positive potential, as will be described hereinafter. The contact CP2 of the switch CP is connected on the one hand, via a contact CB10, to the relay coils B04 and B10, and on the other hand to the anode of the photoelectric cell PH, the cathode of which is connected to a relay coil B09. The contact CP2 is also connected to this coil B09 via a pushbutton K2. Finally, the movable contact blade of the switch CP is connected to the positive (+) terminal. In the position of repose, this blade is kept pressed against the contact CP1 by the action exerted by the elevator platform 26.

The control circuit which is shown in FIGS. 7A and 7B again includes a matrix memory 80 which includes a plurality of locations, each location being arranged to contain a single character. It should be noted here that the characters stored in this memory represent the order numbers, in encoded form, that enable various bins to be moved in succession into the unloading position 90, in a manner to be described below. The locations of the memory 80 are selected in succession by a selection switch 81 that advances by one increment each time it receives an electrical pulse transmitted by a delay element 82, the input of the delay element 82 being connected to the output of the drift amplifier AD-2 via a manual contact breaker IT. Extraction of the character, i.e., the order number stored in the memory location selected by the switch 81 is accomplished by reading circuits 83 in response to a pulse sent by the drift amplifier AD-2 and transmitted via the contact breaker IT, which is assumed to be closed. After being extracted from this location, this order number is transferred to an output register RG1. No further detail of the structure of the memory 80, circuits 83 and selection switch 81 will be necessary here, because these structures are similar to those that have been described and shown in accessory fashion in U.S. Pat. No. 3,349,376, which corresponds to French Patent No. 1.368.128.

The register RG1 may also receive an order number stored temporarily in a standby register 84 and generated by a codifier keyboard 85 that is actuated manually by the operator; the transfer of the order number from the register 84 to the register RG1 is effected by way of a gate 86 and is triggered in response to an electrical pulse that is generated by the drift amplifier AD-1 and applied to this gate 86.

The control circuit shown in FIGS. 7A and 7B also includes another output register RG2, which is connected to the output of the reader LME and receives the order numbers transmitted by this reader in the course of the rotation of the turntable 12, at the rate at which the identification labels of the various bins travel past the reader. It should be noted here that just like the standby register 84, the register RG2 is designed in such a manner as to not require resetting to zero prior to receiving an order number; the recording of any order number in this register has the effect of systematically erasing the one that had been recorded beforehand. The outputs of the registers RG1 and RG2 are connected to the inputs of a control block BCP arranged so that in response to receiving a pulse sent by a delay element 87 it will furnish electrical voltages causing the rotation of the circular turntable 12, either in the direction indicated by the arrow G (FIG. 1) or in the opposite direction indicated by the arrow H. The structure of this control block is shown in detail in FIG. 6.

Figure 6:
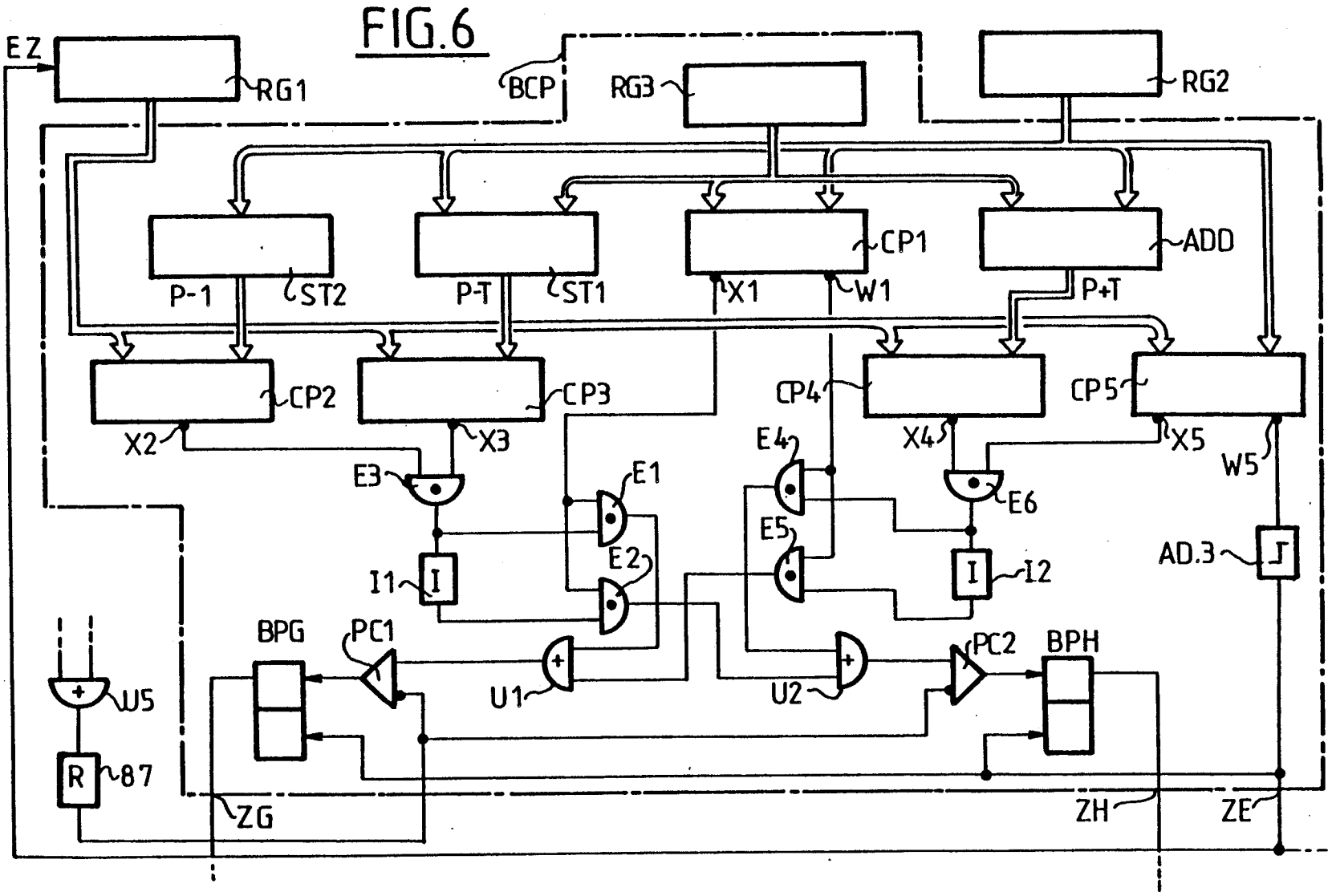
FIG. 6 is a block control diagram for controlling the rotating of the turntable of the apparatus of FIG. 1.

Turning to FIG. 6, the control block BCP includes a register RG3 that in encoded form contains a number T equal to one-half the number N of bins installed on the turntable 12. In the example described, where N=8, T=4. The block BCP also includes a first subtractor ST1, the inputs of which are connected to the outputs of registers RG2 and RG3, and which is arranged to furnish to its output a number P–T representing the difference between the order number P contained in the register RG2 and the number T contained in the register RG3. Block BCP also includes a second subtractor ST2 provided with an input connected to the output of the register RG2 and which second subtractor is arranged to deliver to its output a number P−1 representing the value of the number P reduced by one unit. The block BCP also includes an adder ADD, the inputs of which are connected to the outputs of the registers RG2 and RG3 and which is arranged to furnish at its output a number P+T representing the sum of the numbers contained in these two registers. The outputs of the registers RG2 and RG3 are further connected to the inputs of a first comparator TP1, which is arranged to compare the numbers P and T contained in these registers, and as a result of this comparison to furnish a positive voltage to one output X1 in the case where P is greater than T, or to an output W1, in the case where P is less than or equal to T. A second comparator CP2 has the task of comparing the number P−1 delivered by the subtractor ST2 to the number Q contained in the register RG1. This comparator is arranged to furnish a positive voltage over its single output X2, if the number P−1 is greater than or equal to Q. A third comparator CP3 has the task of comparing the number P−T furnished by the subtractor ST1 to the number Q contained in the register RG1. This comparator is arranged to furnish a positive voltage at its single output X3, if the number P−T is less than Q. A fourth comparator CP4 is assigned the task of comparing the number P+T furnished by the adder ADD to the number Q contained in the register RG1. This comparator CP4 is arranged to furnish a positive voltage at its single output X4 in the case where this number P+T is greater than or equal to Q. Finally, a fifth comparator CP5 has the task of comparing the numbers Q and P contained in the registers RG1 and RG2, respectively. This comparator CP5 has two outputs X5 and W5, and it is arranged to furnish a positive voltage at its output X5, if Q is greater than P, or at its output W5, if these two numbers P and Q are equal.

The output X1 of the comparator CP1 is connected to one of the inputs of each of the two AND circuits E1 and E2. The other input of the circuit E1 is connected to the output of an AND circuit E3. The other input of the circuit E2 is connected, via an inverter I1, to the output of this circuit E3. The circuit E3 has two inputs each connected respectively to each of the outputs X2 and X3 of the comparators CP2 and CP3.

The output W1 of the comparator CP1 is connected to one of the inputs of each of the AND circuits E4 and E5. The other input of the circuit E4 is connected to the output of an AND circuit E6. The other input of the circuit E5 is connected via an inverter I2 to the output of this circuit E6. The circuit E6 has two inputs, each connected respectively to the output X4 of the comparators CP4 and the output X5 of the comparator CP5.

The outputs of the circuit E1 and E5 ar connected to the inputs of an OR circuit U1, which has two inputs, this circuit U1 having its output connected to the conditioning input of a control gate PC1. Similarly, the outputs of the circuits E2 and E4 are connected to the inputs of an OR circuit U2 having two inputs, this circuit U2 having its output connected to the conditioning input of a control gate PC2. The control gates PC1 and PC2 are similar to those described and shown in U.S. Pat. Nos. 3,293,617 and 3,276,767 (corresponding to French Patent Nos. 1.342.787 and 1.387.085). It will be recalled simply that each of these gates includes two inputs, one of which, indicated by a dot in FIG. 8, is a conditioned input to which the electrical pulses to be transmitted are applied, and the other of which is a conditioning input to which an electrical voltage is applied. It will also be recalled that each control gate transmits a pulse applied to its conditioned input only if its conditioning input is at a positive potential. FIG. 8 shows that the conditioned inputs of gates PC1 and PC2 are connected to the output of the delay element 87.

The control block BCP also includes two multivibrators BPG and BPH of a known type. The multivibrator BPG has its "normal" input connected to the output of the gate PC1, while the multivibrator BPH has its "normal" input connected to the output of the gate PC2. The resetting to zero of these multivibrators is assured by a pulse furnished by a drift amplifier AD-3 and applied to the "complementary" input of these multivibrators; this drift amplifier has its input connected to the output W5 of the comparator CP5. The "normal" output of the multivibrator BPG is connected to an output ZG of the block BCP and this output ZG is in turn connected, as shown in FIG. 7B, to the relay coil B01, via an OR circuit U3. Similarly, the "normal" output of the multivibrator BPH is connected to an output ZH of the block BCP, and this output ZH is in turn connected to the relay coil B02, via an OR circuit U4. Finally, the output of the drift amplifier AD-3 is also connected to an output ZE of the block BCP, and this output ZE is connected, as shown in FIG. 7B, both to an input EZ for resetting the register RG1 to zero and to an input EM for controlling startup of the indicator reader LGI.

With the aid of an example, the manner in which a particular bin is moved and positioned in the unloading position 90 will now be explained. It is assumed that initially the bin that is located in this unloading position is the bin C2, and that with this bin empty the elevator platform 26 is in the position of repose. In this case, the movable contact blade of the switch CP is applied to the contact CP1. Additionally, the register RG2 contains the order number of the bin that is immobilized in the unloading position, that is, the numeral 2. Now if the operator wishes to move the bin C8, for example, into this position, then the operator must first, with the aid of the keyboard 85, enter the order number of this bin into the register 84, in this case the numeral 8, and must then press on the pushbutton K1, causing a positive voltage to be applied to the input of the drift amplifier AD-1. As a consequence the drift amplifier furnishes a pulse and applies it on the one hand to the gate 86, which causes the transfer to the register RG1 of the numeral 8 contained in the register 84, and on the other hand, via an OR circuit U5, to the delay element 87. Since the registers RG1 and RG2 then contain the numerals 8 and 2, respectively, a positive voltage appears at the output W1 of the comparator CP1 and at the output X5 of the comparator CP5. As a consequence of the absence of voltage at the outputs X1 and X4, no positive voltage can appear at the output of the circuits E1, E2 and E6. The circuit E4, only one of the inputs of which is at a potential, furnishes no positive voltage at all to its output. Contrarily, since a positive voltage remains at the output of the inverter I2, the two inputs of the circuit E5 are at a positive potential, so that a positive voltage appears at the output of this circuit E5 and is applied, via the circuit U1, to the conditioning input of the gate PC1. Consequently this gate is made conducting. The delayed pulse that is then furnished by the delay element 87 and applied to the conditioned inputs of the gates PC1 and PC2 is transmitted only by the gate PC1, which applies it to the normal input of the multivibrator BPG. As a result, the multivibrator changes to the "1" state. The positive voltage that then appears at the normal output of the multivibrator BPG is applied via the circuit U3 to the coil B01. Now that the coil B01 is excited it closes its contact CB01, which has the effect of exciting the winding Ml and causing the turntable 12 to rotate in the direction of the arrow G. In the course of this rotation, the reader LME furnishes to the register RG2 the order numbers on the various labels traveling past it, and in this case these labels are the ones assigned to the bins C1 and C8. It will be understood now that when the number 8, representing the order number of the bin C8, is transmitted by the reader LME to the register RG2, a positive voltage appears at the output W5 of the comparator CP5. Consequently the drift amplifier AD-3 furnishes an electrical pulse and applies it on the one hand to the input EZ of the register RG1, which assures the resetting of this register to zero, and on the other hand to the complementary inputs of the multivibrators BPG and BPH. As a result, the multivibrator BPG returns to the "zero" state, the effect of which is to de-excite the coil B01 and by the opening of the contact CB01 to cause the stoppage of the turntable 12. This stoppage occurs when the bin C8 has moved slightly past the unloading position 90. Under these conditions, after the stoppage of the turntable 12, it is appropriate to drive the turntable again in the opposite direction, so as to move the bin C8 until it has arrived precisely in the unloading position. This movement of the turntable 12 is triggered by the pulse furnished by the drift amplifier AD-3 and applied to the input EM of the indicator reader LGI. As seen in FIG. 7B, the reader LGI has three outputs XG, XH and XE, and it is arranged so that beginning at the instant when it receives the pulse via its input EM it will furnish electrical pulses either at its output XG or at its output XH, depending on whether the plane of symmetry of the bin that is stopped in proximity with the unloading position is on one side or the other of the plane MM'; this determination is made on the basis of the values read by the reader LGI. In the example described, where the turntable is stopped after having been driven in the direction of the arrow G, these pulses are furnished at the output XH of the reader LGI and are applied via the circuit U4 to the relay coil B02. In response to each of these pulses, the coil B02 instantaneously closes its contact CB02, causing the turntable 12 to rotate in small increments in the direction of the arrow H. In the course of this movement, the bin C8 approaches the unloading position 90, and finally the switch CF of this bin is in connection with the control circuit 91, which is a bidirectional switch including two contacts CF1 and CF2 (FIG. 7A) and one movable contact blade, which when the bin C8 arrives at the position 90 are connected to the relay coils of the circuit 91, details of which are to be given hereinafter. The transmission of the pulses via the output XH of the reader LGI stops when the plane of symmetry of the bin C8 coincides exactly with the plane MM'. At that instant, the reader LGI furnishes a single pulse at its output XE and applies it to a relay coil B05.

The coil B05 excited by this pulse then instantaneously closes its contact CB05. As a result, a direct current circulates from the + terminal, via the closed contact CB05, and excites a coil B06, all of which can be seen from FIG. 7A. Since the movable contact blade of the switch CF is applied to the contact CF1, the same current, via the contact CF1, will excite the coil B03. The excited coil B06 closes its contact CB06 and thus establishes a circuit for holding it and the coil B03 in the position of repose, via the contact CB06 and an inverter contact CB09. The excited coil B03 closes its contact CB03, which causes the excitation of the winding M3 of the motor 35. As a result, the elevator platform 26 is raised to come into contact with the plate 22 of the bin C8. In the course of this motion, the movable contact blade of the switch CP ceases being held pressed against the contact CP1 by the platform 26 and now is applied to the contact CP2 of this switch. The platform 26, as it continues to rise, then raises the plate 22 and the stack of sheets placed on it; this movement continues until the topmost sheet of the stack raises the movable blade of the switch CF. The movable blade then stops contacting the contact CF1 and is applied to the contact CF2 of this switch. Consequently the coil B03 ceases being excited and opens its contact CB03, which de-excites the motor 35 and stops the rising motion of the stack. However, because the coil B06 has been left excited, a direct current now circulates from the + terminal, via the inverter contact CB09 in the position of repose, the closed contact CB06 and the contact CF2, and excites the coil B07. The excited coil B07 closes its contact CB07. A direct current then circulates from the + terminal, via the inverter contact CB09 in the position of repose and the closed contact CB07, and excites both the coil B08 and a control device DCE that controls the excitation of the electromagnet EA of the extractor 24. The excited coil B08 closes its contact CB08 and thus establishes a holding circuit for itself and for the device DCE, via the inverter contact CB09 and the closed contact CB08. Beginning at that instant, the sheets of the stack placed in the bin C8 can be extracted one by one by the device 24 for engagement with the printer 11. In the course of this extraction, the topmost level of the stack of sheets becomes lower, so that finally the movable blade of the switch CF is again pressed against the contact CF1. The effect is to excite the coil B03 once again and thus to bring about the excitation of the motor 35 and the rise once again of the stack, until the movable blade is no longer applied to the contact CF1. It can thus be seen that the height of the stack of sheets always remains substantially at the same level for the entire duration of the extraction operation.

The extraction of the sheets contained in the bin C8 stops when, with all the sheets having been removed from the bin, the cell PH receives the beam of light emitted by the lamp L and then furnishes an electrical voltage to the relay coil B09. The extraction may also be interrupted, even if some sheets remain in the bin C8, if the operator presses on the pushbutton K2 to excite the coil B09. In either of these two cases, the excited coil B09 rocks its contact CB09 into the working position, and the effect is to de-excite the coils B06 and B08 as well as the excitation control device DCE. The de-excited coils B06 and B08 then open their respective contacts CB06 and CB08, which cuts the holding circuits that were assured by these coils. Additionally, as a consequence of the rocking of the contact CB09, a direct current circulates from the + terminal, via the contact CB09 rocked into the working position, and excites two coils B04 and B10. The excited coil B10 then closes its contact CB10 and thus establishes a holding circuit for itself and for the coil B04, via the contact CP2 and the contact CB10, at least for the case where the operator has released the pushbutton K2 and the coil B09 is no longer kept in the excited state. The coil B04, thus excited, then closes its contact CB04, with the effect of exciting the winding M4 of the motor 35 and thus causing the elevator platform 26 to be lowered. The descent of the platform 26 continues until the instant when the platform, after having left the plate 22, attains its position of repose and depresses the movable contact blade of the switch CP. The blade then leaves the contact CP2 and is applied to the contact CP1. As a result, the coils B04 and B10 cease being excited, as does the coil B09 in the case where its excitation was assured by the cell PH. The de-excited coil B09 rocks its contact CB09 into the position of repose, while the de-excited coils B04 and B10 open their respective contacts CB04 and CB10. Consequently the winding M4 of the motor 35 is no longer excited, which stops the descending motion of the platform 26. In addition, however, the application of the movable blade of the switch CP to the contact CP1 has the effect of carrying the input of the drift amplifier AD-2 to a positive potential. Under these conditions, if the operator has taken the precaution of closing the contact breaker IT before the platform 26 has returned to the position of repose, the electrical pulse that is furnished by this drift amplifier is applied on the one hand, via the circuit U5, to the input of the delay element 87 and on the other to the input of the delay element 82 and of the reading circuits 83, which causes the transfer to the register RG1 of the order number that is present in the first location of the memory 80. From that instant, the operations that ensue are similar to those described above, and for that reason no further detail on these operations will be given here. It will simply be noted that in the course of these operations the bin the order number of which is kept in the register RG1 is put into the unloading location first, and then, when the bin is correctly positioned in that location, the stack of sheets in the bin is raised by the platform 26 so as to be put into contact with the separating device 23. After that, the extractor 24 is actuated to enable these sheets to be delivered to the machine 11 one by one. The extraction operation stops either when the bin located in the position 90 is empty or when the operator presses on the pushbutton K2. At that instant, the platform 26 is put into the position of repose, to enable another bin to be put into the unloading position 90, in a manner similar to what has been described above.

The various feed bins that are successively put into the unloading position 90 are defined by the order numbers recorded in a known manner by the operator, before the feed apparatus is started up, in the various successive locations of the memory 80. Under these conditions, if the operator has taken care to close the contact breaker IT, the operations of successively placing the bins in the location 90 and extracting sheets contained in the bins proceed entirely automatically, without any need for operator intervention. However, it should be mentioned that if the operator should for any reason desire to interrupt the course of ongoing operations, it suffices to open the contact breaker IT and press on the pushbutton K2, which returns the elevator platform 26 to the position of repose without triggering the transfer to the register RG1 of an order number contained in the memory 80. Thus although the order in which the bins are successively put into the unloading position may be selected in advance by the operator, it is always possible at any moment for the operator to interrupt the functioning of the feed apparatus and even to change the order, if needed, which lends the apparatus very great versatility.

It should also be pointed out that in the apparatus of the present invention the placement of a bin in the unloading position is obtained by rotating the turntable 12 in a direction such that the turntable always undergoes the least smallest possible rotation. As a consequence, the time required for the placement is always relatively brief.

It will be understood that the invention is in no way limited to the embodiments described and shown herein, which are provided solely by way of example. On the contrary, it includes any technical equivalents of what is described and shown, either individually or in combination, and implemented within the scope of the claims that follow.

What is claimed is:

1. An apparatus for automatic feeding of one document at a time to a document processing machine (11), the apparatus including a plurality of feed bins (C1, C2, C3, . . . , C8) each adapted to contain one stack of documents to be processed, means for fixing the bins to a movable support (12), drive means (15, 16, 28) for displacing said support along a predetermined path enabling each bin to be moved to an unloading position (90) provided with a document extractor (24), the extractor being arranged to control the extraction of the documents one by one from a stack that has been placed in contact with it, said apparatus being characterized in that each of said bins is assigned an order number corresponding to the order in which they succeed one another on the support (12), the apparatus further includes a circuit (91) for control of said drive device (15, 16, 28), the circuit including:

a recognition device (LME) arranged to recognize the order number (P) of the bin which is in the unloading position (90), and for generating electrical signals representative of this order number;

first register means (RG1) for temporarily storing a number (Q) corresponding to a preselected bin which is to be put into the unloading position;

second register means (RG2) for temporarily storing each of the order numbers furnished in succession, in the form of electrical signals, by said recognition device (LME);

and a control block (BCP) connected to said first and second registers (RG1 and RG2) and arranged to excite the drive means (15, 16, 28), as a function of the order numbers (Q and P) respectively contained in the registers, in such a manner as to move said preselected bin into the unloading position (90).

2. A feed apparatus as defined by claim 1, characterized in that it further includes a stack transport mechanism (25) normally occupying a position of repose located spaced apart from the path of the bins, the mechanism being monitored by the control circuit (91) and arranged so that when a preselected bin has been put into the unloading position (90) it will be actuated by this circuit in order to move the stack of documents of the bin into contact with the extractor (24) of this position and thus to permit these documents to be sent one by one through the processing machine (11).

3. A feed apparatus as defined by claim 1 characterized in that the support (12) comprises a horizontal turntable on which the bins are disposed radially, and in that the control block (BCP) is arranged to excite the drive means of the turntable in such a manner that the displacement of the turntable for moving a preselected bin into the unloading position is effected by the smallest rotation possible.

4. A feed apparatus as defined by claim 2 characterized in that the support (12) comprises a horizontal turntable on which the bins are disposed radially, and in that the control block (BCP) is arranged to excite the drive means of the turntable in such a manner that the displacement of the turntable for moving a preselected bin into the unloading position is effected by the smallest rotation possible.

5. A feed apparatus as defined by claim 3, characterized in that the turntable being provided with identification labels (ME1, ME2, . . . , ME8), each associated respectively with each of the bins (C1, C2, . . . , C8) and each having a distinctive marking corresponding to the order number of the associated bin, the recognition device (LME) comprises a label reader arranged so that in the course of rotation of the turntable it can read the markings carried by the labels of the turntable, and so that each time a bin arrives in the unloading position (90) it will generate electrical signals representative of the order number (P) of the bin.

6. A feed apparatus as defined by claim 4, characterized in that the turntable being provided with identification labels (ME1, ME2, . . . , ME8), each associated respectively with each of the bins (C1, C2, . . . , C8) and each having a distinctive marking corresponding to the order number of the associated bin, the recognition device (LME) comprises a label reader arranged so that in the course of rotation of the turntable it can read the markings carried by the labels of the turntable, and so that each time a bin arrives in the unloading position (90) it will generate electrical signals representative of the order number (P) of the bin.

7. A feed apparatus as defined by claim 5, characterized in that the control block (BCP) includes:

a third register (RG3) containing a number (T) equal to one-half the number of bins disposed on the turntable (12);

a first comparator (CP1), connected to said second and third registers (RG2 and RG3), and being provided with an output (X1) and arranged to furnish a signal at that output when the order number (P) contained in said second register (RG2) is greater than the number (T) contained in said third register (RG3);

a first subtractor (ST1), connected to said second and third registers (RG2 and RG3), and provided with an output and arranged to furnish at that output a number (P–T) representing the difference between the order number (P) contained in the second register and the number (T) contained in the third register;

a second subtractor (ST2), connected to said second register, and being provided with an output and arranged to furnish at this output a number (P—1) corresponding to the order number (P) contained in the second register, but reduced by one unit;

a second comparator (CP2), connected to the first register (RG1) and the second subtractor (ST2), and being provided with an output (X2) and arranged to furnish a signal at this output when the number (P—1) furnished by this second subtractor is at least equal to the order number (Q) contained in this first register;

a third comparator (CP3) connected to the first register (RG1) and to the first subtractor (ST1), and being provided with an output (X3) and arranged to furnish a signal at this output when the number (P–T) furnished by this first subtractor is less than the order number (Q) contained in the first register;

and a group of logic circuits (E1, E2, E3, I1), connected to the outputs (X2 and X3) of said second and third comparators and to the outputs (X1) of the first comparator, these circuits being arranged in such a way that in response to the signals furnished simultaneously at these three outputs, they send the turntable drive device an excitation signal that causes the rotation of the turntable in a first direction (G), which is the direction in which the bins succeed one another on the turntable, while in the absence of a signal at at least one of the outputs of the second and third comparators, but in the presence of a signal furnished at the output (X1) of the first comparator, they send this drive device an excitation signal that causes the rotation of the turntable in a second direction (H) opposite said first direction (G).

8. A feed apparatus as defined by claim 6, characterized in that the control block (BCP) includes:

a third register (RG3) containing a number (T) equal to one-half the number of bins disposed on the turntable (12);

a first comparator (CP1), connected to said second and third registers (RG2 and RG3), and being provided with an output (X1) and arranged to furnish a signal at that output when the order number (P) contained in said second register (RG2 is greater than the number (T) contained in said third register (RG3);

a first subtractor (ST1), connected to said second and third registers (RG2 and RG3), and provided with an output and arranged to furnish at that output a number (P–T) representing the difference between the order number (P) contained in the second register and the number (T) contained in the third register;

a second subtractor (ST2), connected to said second register, and being provided with an output and arranged to furnish at this output a number (P—1) corresponding to the order number (P) contained in the second register, but reduced by one unit;

a second comparator (CP2), connected to the first register (RG1) and the second subtractor (ST2), and being provided with an output (X2) and arranged to furnish a signal at this output when the number (P—1) furnished by this second subtractor is at least equal to the order number (Q) contained in this first register;

a third comparator (CP3) connected to the first register (RG1) and to the first subtractor (ST1), and being provided with an output (X3) and arranged to furnish a signal at this output when the number (P-T) furnished by this first subtractor is less than the order number (Q) contained in the first register;

and a group of logic circuits (E1, E2, E3, I1), connected to the outputs (X2 and X3) of said second and third comparators and to the outputs (X1) of the first comparator, these circuits being arranged in such a way that in response to the signals furnished simultaneously at these three outputs, they send the turntable drive device an excitation signal that causes the rotation of the turntable in a first direction (G), which is the direction in which the bins succeed one another on the turntable, while in the absence of a signal at at least one of the outputs of the second and third comparators, but in the presence of a signal furnished at the output (X1) of the first comparator, they send this drive device an excitation signal that causes the rotation of the turntable in a second direction (H) opposite said first direction (G).

9. A feed apparatus as defined by claim 7, characterized in that, with the first comparator (CP1) further being provided with a second output (1) and being arranged to furnish a signal at this second output when the order number (P) contained in the second register (RG2) is at most equal to the number (T) contained in the third register (RG3), the control block (BCP) further includes:

an adder (ADD) connected to said second and third registers (RG2 and RG3), this adder being provided with an output and being arranged to furnish at this output a number (P+T) representing the sum of the order number (P) contained in the second register and of the number (T) contained in the third register;

a fourth comparator (CP4) connected to said adder (ADD) and to the first register (RG1), this comparator being provided with an output (X4) and being arranged to furnish a signal at this output when the order number (Q) contained in this first register is equal at most to the number (P+T) furnished by this adder;

a fifth comparator (CP5) connected to the first and second registers (RG1 and RG2), this comparator being provided with a first output (X5) and a second output (W5) and being arranged to furnish a signal, either at its first output in the case where the order number (Q) contained in the first register (RG1) is greater than the order number (P) contained in the second register (RG2), or at its second output in the case where these two order numbers are equal;

and a second group of logic circuits (E4, E5, E6, I2) connected to the second output (W1) of the first comparator (CP1), to the output (X4) of said fourth comparator (CP4), and to the first output (X5) of said fifth comparator (CP5), these circuits being arranged in such a way that in response to the signals furnished simultaneously at these last three outputs, they send the turntable drive device an excitation signal that causes the rotation of the turntable in the second direction (H), while in the absence of a signal either at the output of the fourth comparator or at the first output of the fifth comparator but in the presence of a signal furnished to the second output of the first comparator, they send this drive device an excitation signal which causes the rotation of the turntable in the first direction (G).

10. A feed apparatus as defined by claim 8, characterized in that, with the first comparator (CP1) further being provided with a second output (1) and being arranged to furnish a signal at this second output when the order number (P) contained in the second register (RG2) is at most equal to the number (T) contained in the third register (RG3), the control block (BCP) further includes:

an adder (ADD) connected to said second and third registers (RG2 and RG3), this adder being provided with an output and being arranged to furnish at this output a number (P+T) representing the sum of the order number (P) contained in the second register and of the number (T) contained in the third register;

a fourth comparator (CP4) connected to said adder (ADD) and to the first register (RG1), this comparator being provided with an output (X4) and being arranged to furnish a signal at this output when the order number (Q) contained in this first register is equal at most to the number (P+T) furnished by this adder;

a fifth comparator (CP5) connected to the first and second registers (RG1 and RG2), this comparator being provided with a first output (X5) and a second output (W5) and being arranged to furnish a signal, either at its first output in the case where the order number (Q) contained in the first register (RG1) is greater than the order number (P) contained in the second register (RG2), or at its second output in the case where these two order numbers are equal;

and a second group of logic circuits (E4, E5, E6, I2) connected to the second output (W1) of the first comparator (CP1), to the output (X4) of said fourth comparator (CP4), and to the first output (X5) of said fifth comparator (CP5), these circuits being arranged in such a way that in response to the signals furnished simultaneously at these last three outputs, they send the turntable drive device an excitation signal that causes the rotation of the turntable in the second direction (H), while in the absence of a signal either at the output of the fourth comparator or at the first output of the fifth comparator but in the presence of a signal furnished to the second output of the first comparator, they send this drive device an excitation signal which causes the rotation of the turntable in the first direction (G).

11. A feed apparatus as defined by claim 9, characterized in that the control block (BCP) also includes a stop signal generator (AD-3) connected to the second output (W5) of the fifth comparator (CP5) and arranged so that in response to a signal furnished to this second output it will send the turntable drive device a stop signal, which has the effect of stopping the rotation of the turntable (12).

12. A feed apparatus as defined by claim 10, characterized in that the control block (BCP) also includes a stop signal generator (AD-3) connected to the second output (W5) of the fifth comparator (CP5) and arranged so that in response to a signal furnished to this second output it will send the turntable drive device a stop signal, which has the effect of stopping the rotation of the turntable (12).

13. A feed apparatus as defined by claim 11, characterized in that the turntable (12) being further provided with position indicator groups (GI1, GI2, . . . , GI8), each assigned to each of the bins (C1, C2, . . . , C8) and each including a plurality of position indicators serving to mark the position with respect to the unloading position (90) of a bin that has been stopped in proximity with this position, the control circuit (91) also includes an indicator reader (LGI) provided with an input (EM) connected to the stop signal generator (AD-3) so as also to receive the signal that is sent by this generator, this reader being arranged so that beginning when it receives a signal applied to its input (EM) it will furnish the turntable drive device, as a function of the reading of the position indicators corresponding to the bin that has been stopped in proximity with said unloading position, with electrical pulses that have the effect of causing the turntable to rotate and of moving this bin toward this position until the bin has arrived precisely in this position.

14. A feed apparatus as defined by claim 12, characterized in that the turntable (12) being further provided with position indicator groups (GI1, GI2, . . . , GI8), each assigned to each of the bins (C1, C2, . . . , C8) and each including a plurality of position indicators serving to mark the position with respect to the unloading position (90) of a bin that has been stopped in proximity with this position, the control circuit (91) also includes an indicator reader (LGI) provided with an input (EM) connected to the stop signal generator (AD-3) so as also to receive the signal that is sent by this generator, this reader being arranged so that beginning when it receives a signal applied to its input (EM) it will furnish the turntable drive device, as a function of the reading of the position indicators corresponding to the bin that has been stopped in proximity with said unloading position, with electrical pulses that have the effect of causing the turntable to rotate and of moving this bin toward this position until the bin ha arrived precisely in this position.

15. A feed apparatus as defined by claim 13, characterized in that the indicator reader (LGI) also being arranged to furnish a pulse at an output (XE) at the instant when a bin is immobilized precisely in the unloading position (90), the control circuit (91) also includes a control assembly (B05, CB05, B06, CB06, B03, CB03, B09, CB09, B10, CB10, B04) intended to control the stack transport mechanism (25), this control assembly being connected to said output (XE) of the indicator reader and being arranged so that in response to a pulse furnished to this output, it will control this transport mechanism in order to move the stack of documents contained in the bin that is immobilized in the unloading position into contact with the extractor (24).

16. A feed apparatus as defined by claim 14, characterized in that the indicator reader (LGI) also being arranged to furnish a pulse at an output (XE) at the instant when a bin is immobilized precisely in the unloading position (90), the control circuit (91) also includes a control assembly (B05, CB05, B06, CB06, B03, CB03, B09, CB09, B10, CB10, B04) intended to control the stack transport mechanism (25), this control assembly being connected to said output (XE) of the indicator reader and being arranged so that in response to a pulse furnished to this output, it will control this transport mechanism in order to move the stack of documents contained in the bin that is immobilized in the unloading position into contact with the extractor (24).

17. A feed apparatus as defined by claim 15, characterized in that the control circuit (91) further includes a second control assembly (K2, L, PH, CP1, CP2) intended to be actuated either automatically, when all the documents of the bin immobilized in the unloading position have been removed from the bin, or manually beginning at the instant when the transport mechanism has departed from its position of repose, this second assembly being connected to the first control assembly and being arranged so that when it is actuated it furnishes a signal to this first assembly to permit it to control the return to the position of repose of this transport mechanism.

18. A feed apparatus as defined by claim 16, characterized in that the control circuit (91) further includes a second control assembly (K2, L, PH, CP1, CP2) intended to be actuated either automatically, when all the documents of the bin immobilized in the unloading position have been removed from the bin, or manually beginning at the instant when the transport mechanism has departed from its position of repose, this second assembly being connected to the first control assembly and being arranged so that when it is actuated it furnishes a signal to this first assembly to permit it to control the return to the position of repose of this transport mechanism.

19. A feed apparatus as defined by claim 1 characterized in that the control circuit (91) also includes memorization means (80, 81, 82, 83) containing the order numbers of bins intended to be immobilized successively in the unloading position, these means being connected to the first register (RG1) and being arranged so that each time they are excited they furnish an order number to this register, in order to permit the feed bin corresponding that order number to be moved into said unloading position.

20. A feed apparatus as defined by claim 2 characterized in that the control circuit (91) also includes memorization means (80, 81, 82, 83) containing the order numbers of bins intended to be immobilized successively in the unloading position, these means being connected to the first register (RG1) and being arranged so that each time they are excited they furnish an order number to this register, in order to permit the feed bin corresponding that order number to be moved into said unloading position.

21. A feed apparatus as defined by claim 3 characterized in that the control circuit (91) also includes memorization means (80, 81, 82, 83) containing the order numbers of bins intended to be immobilized successively in the unloading position, these means being connected to the first register (RG1) and being arranged so that each time they are excited they furnish an order number to this register, in order to permit the feed bin corresponding that order number to be moved into said unloading position.

22. A feed apparatus as defined by claim 5 characterized in that the control circuit (91) also includes memorization means (80, 81, 82, 83) containing the order numbers of bins intended to be immobilized successively in the unloading position, these means being connected to the first register (RG1) and being arranged so that each time they are excited they furnish an order number to this register, in order to permit the feed bin corresponding that order number to be moved into said unloading position.

23. A feed apparatus as defined by claim 7 characterized in that the control circuit (91) also includes memorization means (80, 81, 82, 83) containing the order numbers of bins intended to be immobilized successively in the unloading position, these means being connected to the first register (RG1) and being arranged so that each time they are excited they furnish an order number to this register, in order to permit the feed bin corresponding that order number to be moved into said unloading position.

24. A feed apparatus as defined by claim 9 characterized in that the control circuit (91) also includes memorization means (80, 81, 82, 83) containing the order numbers of bins intended to be immobilized successively in the unloading position, these means being connected to the first register (RG1) and being arranged so that each time they are excited they furnish an order number to this register, in order to permit the feed bin corresponding that order number to be moved into said unloading position.

25. A feed apparatus as defined by claim 11 characterized in that the control circuit (91) also includes memorization means (80, 81, 82, 83) containing the order numbers of bins intended to be immobilized successively in the unloading position, these means being connected to the first register (RG1) and being arranged so that each time they are excited they furnish an order number to this register, in order to permit the feed bin corresponding that order number to be moved into said unloading position.

26. A feed apparatus as defined by claim 13 characterized in that the control circuit (91) also includes memorization means (80, 81, 82, 83) containing the order numbers of bins intended to be immobilized successively in the unloading position, these means being connected to the first register (RG1) and being arranged so that each time they are excited they furnish an order number to this register, in order to permit the feed bin corresponding that order number to be moved into said unloading position.

27. A feed apparatus as defined by claim 15 characterized in that the control circuit (91) also includes memorization means (80, 81, 82, 83) containing the order numbers of bins intended to be immobilized successively in the unloading position, these means being connected to the first register (RG1) and being arranged so that each time they are excited they furnish an order number to this register, in order to permit the feed bin corresponding that order number to be moved into said unloading position.

28. A feed apparatus as defined by claim 17 characterized in that the control circuit (91) also includes memorization means (80, 81, 82, 83) containing the order numbers of bins intended to be immobilized successively in the unloading position, these means being connected to the first register (RG1) and being arranged so that each time they are excited they furnish an order number to this register, in order to permit the feed bin corresponding that order number to be moved into said unloading position.

* * * * *